US005680014A

United States Patent [19]

Miyamoto et al.

[11] Patent Number: 5,680,014

[45] Date of Patent: Oct. 21, 1997

[54] METHOD AND APPARATUS FOR GENERATING INDUCED PLASMA

[75] Inventors: Masahiro Miyamoto; Mamoru Yamada, both of Kanagawa; Tadahiro Sakuta, Ishikawa, all of Japan

[73] Assignee: Fuji Electric Co., Ltd., Kawasaki, Japan

[21] Appl. No.: 406,322

[22] Filed: Mar. 17, 1995

[30] Foreign Application Priority Data

Mar. 17, 1994 [JP] Japan ..... 6-046247

[51] Int. Cl.[6] ..... H05H 1/26; H05H 1/30

[52] U.S. Cl. ..... 315/111.41; 315/111.51; 219/121.11; 219/121.57; 219/121.52

[58] Field of Search ..... 315/111.21, 111.41, 315/111.51; 219/121.54, 121.52, 121.11, 121.34, 121.13, 121.14, 121.15, 121.57, 121.19; 313/161; 204/192.12, 298.08; 118/723 DC

[56] References Cited

U.S. PATENT DOCUMENTS

| | | | |
|---|---|---|---|
| 3,248,513 | 4/1966 | Sunnen | 219/121.11 |
| 3,324,334 | 6/1967 | Reed | 313/231 |
| 3,453,474 | 7/1969 | Cann | 313/161 |
| 4,812,166 | 3/1989 | Saiki et al. | 315/111.51 |
| 5,015,493 | 5/1991 | Gruen | 427/38 |
| 5,233,155 | 8/1993 | Frind | 219/121.52 |

FOREIGN PATENT DOCUMENTS

| | | |
|---|---|---|
| 157407 | 10/1985 | European Pat. Off. . |
| 358804 | 3/1990 | European Pat. Off. . |
| 2591842 | 6/1987 | France . |
| 1168946 | 11/1989 | Japan . |
| 9101077 | 1/1991 | WIPO . |

*Primary Examiner*—Robert Pascal
*Assistant Examiner*—Arnold Kinkead
*Attorney, Agent, or Firm*—Greer, Burns & Crain,Ltd.

[57] ABSTRACT

An induced plasma generating apparatus comprises: a seed gas supply unit for supplying a seed gas, a first chamber for receiving the seed gas: a DC current source; a pair of electrodes connected to the DC current source for causing a discharge in the first chamber to generate a plasma from the seed gas; a nozzle for ejecting the plasma from the first chamber; a second chamber for receiving the plasma ejected from the first chamber; an AC current source; and a coil connected to the AC current source and disposed to surround the second chamber for producing a magnetic field in the second chamber. An induced plasma is generated by subjecting plasma in the second chamber to the magnetic field.

14 Claims, 6 Drawing Sheets

80 CARRIER GAS
15 SECOND COIL
14 AC SOURCE
19, 18 INDUCED PLASMA
10 RF SOURCE

METHOD AND APPARATUS FOR GENERATING INDUCED PLASMA

BACKGROUND OF THE INVENTION

1. Field of the Invention

The present invention relates to a method and apparatus for generating RF induced plasma.

2. Description of the Related Art

When an electric field is formed in space by a radio-frequency (RF) voltage, oscillations of electrons occur in the space. The electrons repeatedly collide with a neutral gas and ionize it, so that ions increase in number and plasma is generated. In order to generate RF induced plasma, it is not required to directly place electrodes in the space. It is thus possible to avoid contamination by electrode-produced impurities. For this reason, in the fields of the plasma chemistry and the plasma CVD, the RF induced plasma is often used for depositing films and etching.

FIG. 5 is a sectional view of a conventional plasma generating apparatus. Flanges 4 and 9 are mounted on the top and bottom, respectively of an insulating cylindrical container 2. An upper cap 5 is put on the upper flange 4. An insulating tube 11 is fixed in the center of the flanges 4 and 9. Between the insulating tube 11 and the insulating container 2, cooling water 3 and a coil 1 supported by a coil former, which is not shown, are placed. The coil 1, which consists of a conductor with an insulating coating, is helically wound around the insulating tube 11, along the axis of the tube, and has its both ends connected to an RF power source 10.

The apparatus has an insulating tube 8A which allows a carrier gas 8 to flow therethrough and an insulating tube 13 which allows a seed gas 7 to flow therethrough, disposed in the center of the cap 5. The cap 5 has horizontal holes 7A and 6A which connect with the inside of the insulating tube 11. The holes 7A and 6A are adapted to introduce the seed gas 7 and a sheath gas 6, respectively, into the insulating tube 11. A helical spacer 6B is interposed between the upper inside surface of the insulating tube 11 and the outside surface of the insulating tube 13. The resultant space is formed helically, thereby allowing the sheath gas 6 to be introduced into the insulating tube 11 along a helical path. Although not shown, the entire apparatus of FIG. 5 is housed within a vacuum vessel.

The mechanism of the generation of induced plasma 12 within the insulating tube 11 will be described below. First, the seed gas 7 is introduced into a vacuum within the insulating tube 11 via the horizontal hole 7A. An inert gas, such as argon (Ar), is used for the seed gas 7. The seed gas 7 serves as the source for generating the plasma 12. At the same time, a sheath gas 6, such as argon, is also introduced into the insulating tube 11 via the horizontal hole 6A. In this case, the sheath gas is allowed to flow helically along the inside surface of the insulating tube 11 as indicated by broken lines, owing to the provision of the helical spacer 6B. When, in this state, an RF current is supplied by the RF power source 10 to the coil 1, an RF magnetic field is produced within the insulating tube 11 along its axis. At this point, an induced current will flow around the central axis of the insulating tube 11 in such a way as to cancel that RF magnetic field. At first the molecules in the seed gas 7 are neutral. When a very small number of electrons contained in the seed gas are caused by the RF magnetic field to oscillate within the insulating tube 11 in the direction of its circumference, they collide with the neutral molecules, so that the molecules are ionized. As a result, ions and electrons increase in number, so that the seed gas is converted into plasma. The induced plasma 12 of FIG. 5 is generated by the mechanism described above. An induced current flows in the induced plasma 12, and the temperature inside the induced plasma rises in a range from thousands to tens of thousands of degrees by the Joule effect.

The sheath gas 6 is utilized to prevent the induced plasma 12 from coming into direct contact with the inside wall surface of the insulating tube 11. The sheath gas 6 cools the outer surface of the plasma 12 while flowing helically along the inside wall surface of the insulating tube 11, whereby the induced plasma 12 is positioned in the vicinity of the central axis of the insulating tube 11. By the flow of the cooling water 3, not only the coil 1 and the insulating tube 11 but also the sheath gas 6 is cooled, thereby preventing the sheath gas 6 itself from being converted into plasma.

After the induced plasma 12 is formed, the carrier gas 8 is introduced from the top of the insulating tube 11 and then mixed with the induced plasma 12. The high temperature of the plasma allows carrier gas 8 to react with the seed gas 7. A reactant gas is taken out from the bottom of the insulating tube 11. The carrier gas 8 may be a gas or may be a mixture of a gas and powder. The induced plasma 12 may be used for plasma film deposition and plasma etching in semiconductor device manufacturing techniques. The induced plasma 12 may also used in apparatus for decomposing fluorocarbons, which is the culprit behind the ozone layer destruction, by plasma.

However, the apparatus of FIG. 5 has a problem that, when a large diameter plasma is generated, the temperature distribution inside the plasma becomes non-uniform. In this apparatus, an RF current having a frequency range from several to tens of MHz flows through the coil 1, and most of the induced current flows along the outer surface of the induced plasma due to the skin effect. As a result, the high-temperature region is positioned to the side of the outer surface of the induced plasma, and a sufficient rise in temperature cannot be obtained inside. With the apparatus of FIG. 5, therefore, it is impossible to generate a practical induced plasma that has a diameter in the range of 50 to 60 mm. With plasma processing apparatus, it is desired to employ a plasma having uniform temperature distribution and the largest possible diameter for increasing plasma processing capabilities.

FIG. 6 is a sectional view of another conventional plasma generating apparatus, which is capable of generating a plasma having uniform temperature distribution even if its diameter is relatively large. The principle of the plasma generation by this apparatus is published by the inventors of the present invention in Sakuda et al., "On Stable Generation of a Low-Frequency High-Power Induction Thermal Plasma", Japan AEM Institute Journal, Vol. 1, No. 1, pp. 25–30, June 1993.

FIG. 6 shows a two-stage plasma generating apparatus. Except for the insulating tube 8A and the flange 9, the upper-stage of this apparatus is constructed identical to the apparatus of FIG. 5. According, like reference numerals are used to denote parts corresponding to those in FIG. 5 and their description is omitted. The lower-stage is provided with another insulating container 21 which is interposed between flanges 41 and 42. Inside the insulating container 21 are placed insulating tubes 22 and 23 between which a helical spacer 60B is inserted. The flange 41 is formed with horizontal holes 80A and 60A which connect with the inside of the insulating tube 22, the hole 80A being adapted to introduce a carrier gas 80 into the insulating tube 22 and the hole 60A being adapted to introduce a sheath gas 60 into the insulating tube 22. A second coil 15, which is immersed in cooling water 20, is placed in the insulating tube 21, and is connected to an AC power source 14. The second coil 15, which consists of a conductor with an insulating coating, is wound around the circumference of the insulating tube 22. In the apparatus of FIG. 5, the carrier gas 8 is fed into the insulating tube 11 via the cap 5, while it is fed via the horizontal hole 80A of the flange 41 in the apparatus of FIG. 6. The first coil 1 is supplied with an RF current of a frequency in the radio frequency range of a megahertz to tens of megahertz, and the second coil 15 is supplied with an alternating current of non-radio frequency, e.g., 500 kHz or below.

In the apparatus of FIG. 6, the induced plasma 18 formed within the first coil 1 is due to the same mechanism as the induced plasma 12 in the apparatus of FIG. 5. The induced plasma 18 moves downwards in accordance with the flow of the seed gas 7 into the insulating tube 22 that is greater in inside diameter than the insulating tube 11 and then mixes with the carrier gas 80 introduced via the horizontal hole 80A. An induced current is produced within the insulating tube 22 by a magnetic field produced by the second coil 15 wound around the insulating tube 22. Since the gas in the plasma state flows into the insulating tube 22, the induced plasma 19 is produced. In this case, since the inside diameter of the insulating tube 22 is greater than that of the insulating tube 11, the induced plasma 18 grows in the direction of radius of the insulating tube 22 into the induced plasma 19.

Since the sheath gas 60 is guided by the helical spacer 60B into the insulating tube 22, it flows helically along the inner wall of the insulating tube 22. The sheath gas 60 prevents the plasma 19 from coming into direct contact with the insulating tube 22. As can be seen from the foregoing, the induced plasma 18 serves as an initiating source for the induced plasma 19. Since the frequency of the alternating current flowing through the second coil 15 is in the non-radio frequency range of 500 kHz or below, the induced plasma 19 will not initiate by itself. With the apparatus shown in FIG. 6, the inside diameter d of the upper insulating tube 11 need not necessarily be 50 to 60 mm. The induced plasma 18 has only to be initiated and its inside temperature distribution need not be uniform. When the induced plasma 18 grows into the induced plasma 19, the entire plasma 19 is heated uniformly by the induced current produced by the second coil 15. For example, if the inside diameter d of the insulating tube 11 is set to 100 mm and the inside diameter D of the insulating tube 22 is set to 300 mm, a plasma which is greater than 100 mm in diameter and has a uniform temperature distribution will be formed. The reason is as follows: The induced current produced by the first coil 1 is of a radio frequency of a megahertz or above, so the induced current will flow mainly on the side of the surface of the induced plasma 18 due to the skin effect. On the other hand, the frequency of the induced current produced by the second coil 15 is low being of the order of 500 KHz or below, so the skin effect is weakened and hence it becomes easy for the induced current to flow into the inside of the plasma 19. Thus, a uniform temperature distribution is attained inside of the plasma 19.

The frequency of the AC power source 14 may be in the range of hundreds of hertz to kilohertz. As the frequency of the AC power source 14 becomes lower, the skin effect is weakened and the temperature inside the plasma 19 becomes invariant. Therefore, while the inside diameter d of the insulating tube 11 is limited to 50 to 60 mm in the apparatus of FIG. 5, the inside diameter D of the insulating tube 22 of the apparatus of FIG. 6 can be enlarged to several hundreds of millimeters to obtain uniform plasma 19. Even if a plasma having a diameter of several hundreds of millimeters is formed by the apparatus of FIG. 6, the entire plasma becomes substantially uniform in temperature, thus permitting plasma processing to be performed in a large area and producing a significant improvement in the plasma processing efficiency.

However, the above-described conventional apparatuses suffer from the disadvantage that the RF power source 10 is required.

In order to initiate a plasma seed gas, an RF power source that can generate a current at a frequency of at least a megahertz or above, preferably in a radio frequency range of several megahertz to tens of megahertz, and has an output capacity of several tens of kilowatts, must be provided. Such an RF power source is large and costly and produces a very large amount of heat. Thus, an apparatus that uses such an RF power source and a facility for such an apparatus become large and costly.

An apparatus for initiating a plasma without an RF power source is disclosed in the Japanese Laid-open Utility Model Publication No. 1 - 168946. In this apparatus, a high voltage is applied between paired electrodes disposed at each end of an insulating tube, and which are opposed to each other in the direction of its axis so that a discharge will take place inside the insulating tube to thereby generate a plasma. However, since the paired electrodes are disposed at each end of the insulating tube, a very high voltage is required to cause a discharge.

SUMMARY OF THE INVENTION

It is accordingly an object of the present invention to provide an induced plasma generating method and apparatus which permits the generation of an induced plasma which is large and uniform in temperature distribution without an RF power source.

It is another object of the present invention to provide a plasma generating method and apparatus which permit an induced plasma to be generated by the use of a relatively low voltage.

It is still another object of the present invention to provide an induced plasma generating apparatus which is small and inexpensive.

It is a further object of the present invention to provide an induced plasma generating method and apparatus which require only small and inexpensive support facilities.

It is a still further object of the present invention to provide an induced plasma generating method and apparatus which permits an induced plasma to be generated efficiently and economically.

According to an aspect of the present invention, there is provided an induced plasma generating method comprising the steps of: generating a plasma by causing a discharge between paired electrodes with a DC power source in a first chamber containing a seed gas; feeding the plasma into a second chamber; and generating an induced plasma by causing a magnetic field generated by an AC current to act on the plasma in the second chamber.

The method may further comprise the step of producing a high-voltage pulse using the DC power source. The plasma is generated by applying the high-voltage pulse between the paired electrodes and causing a discharge in the seed gas.

The method may further comprise the step of applying a voltage between the paired electrodes after the step of generating a plasma. The voltage is preferably within a range of 30 to 50 volts.

The plasma generated in the first step may be fed into the second chamber by the pressure of the seed gas supplied to the first chamber. The flow rate of the seed gas supplied to the first chamber is preferably within a range of 10 to 30 l/min.

The frequency of the AC current is preferably 500 kHz or below.

The method may further comprise the step of generating a second plasma in a third chamber using a DC power source. The AC current may be caused to act on the plasma and the second plasma to generate an induced plasma.

According to the other aspect of the present invention there is provided an induced plasma generating apparatus comprising: a seed gas supply unit for supplying a seed gas; a first chamber for receiving the seed gas; a DC power source for generating a DC voltage; a pair of electrodes connected to the DC power source for causing a discharge in the first chamber in order to generate a plasma from the seed gas; a nozzle for ejecting the plasma from the first chamber; a second chamber for receiving the plasma ejected from the first chamber through the nozzle; an AC power source for generating an AC current; and a coil connected to the AC power source and disposed to surround the second chamber for producing a magnetic field in the second chamber to generate an induced plasma from the plasma.

The apparatus may further comprise a high-voltage pulse generating means connected across the DC power source for generating a high-voltage pulse used to generate the plasma in the first chamber.

One of the paired electrodes may form a container that defines the first chamber.

The apparatus may further comprise an insulating tube for defining the second chamber.

The plasma may be fed from the first chamber into the second chamber by the pressure of the seed gas supplied by the seed gas supply means to the first chamber.

The flow rate of the seed gas supplied from the seed gas supply means to the first chamber should preferably range from 10 to 30 l/min.

The frequency of the AC current is preferably not higher than 500 kHz.

The apparatus may further comprise a third chamber for receiving a seed gas; and a second pair of electrodes connected to a DC power source for causing a discharge in said third chamber to generate a second plasma in the third chamber. The induced plasma may be generated by subjecting the plasma and the second plasma to the magnetic field produced by the coil connected to the AC power source.

DESCRIPTION OF THE PREFERRED EMBODIMENTS

Figure 1:
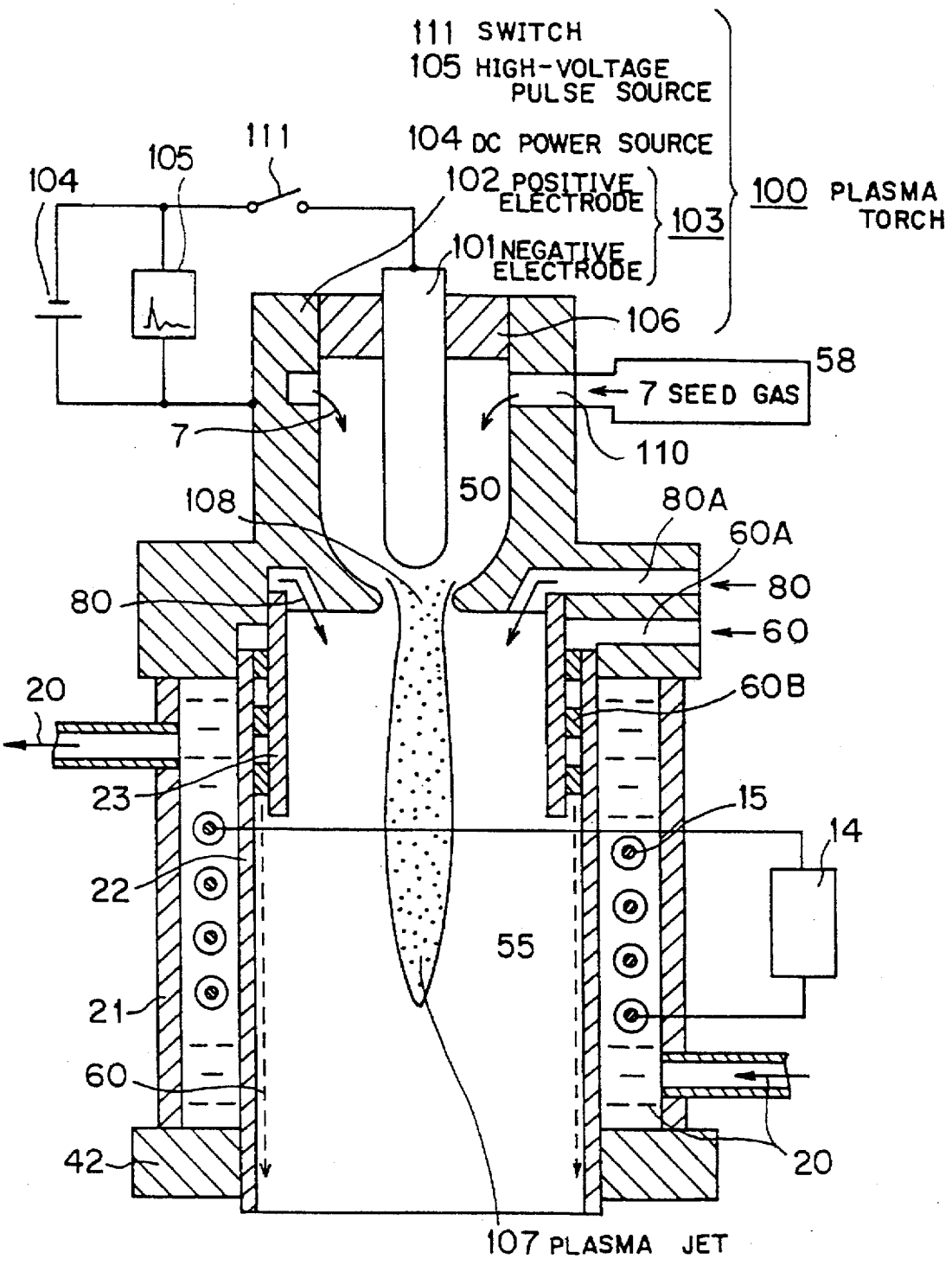
FIG. 1 is a sectional view of a plasma generating apparatus according to a first embodiment of the present invention.

Hereinafter, plasma generating apparatuses embodying the invention will be described with reference to the accompanying drawings in which like reference numerals are used to denote parts corresponding in function to those in the conventional plasma generating apparatus described above.

Embodiment 1

As shown in FIG. 1, a plasma generating apparatus of this embodiment comprises a seed gas supply unit 58 for supplying a seed gas 7 serving as the seeds for generating the plasma and a plasma torch 100 having a chamber (first chamber) 50 adapted to receive and store the seed gas 7 inside the torch 100. The torch 100 includes a DC power source 104, a high-voltage pulse power source 105, a switch 111, an insulator 106, and a pair of electrodes 103. The pair of electrodes 103 comprises a negative electrode 101 and a positive electrode 102, which are connected in parallel to the DC power source 104 and the high-voltage pulse power source 105. The output capacity of the DC power source 104 is, for example, about 1 kW. The positive electrode 102 forms a container that defines the chamber 50 and supports the negative electrode 101 through the use of the insulator 106. Part of the negative electrode 101 is located in the chamber 50. Plasma is generated from the seed gas 7 in the chamber 50 by a discharge between the negative electrode 101 and the positive electrode 102. The upper end of the chamber 50 is defined by the insulator 106 and the negative electrode 101, and its lower end connect with a chamber 55 (second chamber) through a nozzle 108. In the present embodiment, argon (Ar) is used as the seed gas 7; however, any other rare gas, such as helium (He), neon (Ne), or the like may be used. The negative electrode 101 may be made of tungsten, copper-tungsten, or the like. The positive electrode 102 may be made of copper, brass, or the like.

The present embodiment further comprises insulating tubes 22 and 23 which are disposed to contact the lower portion of the positive electrode 102. The chamber 55 is located within the insulating tube 22 and/or the insulating tube 23. The positive electrode 102 is formed at its lower portion with a horizontal hole 80A for feeding a carrier gas 80 into the chamber 55, a horizontal hole 60A for feeding a sheath gas 60 into the chamber 55, and the nozzle 108 for ejecting a plasma jet 107 from the chamber 50 to the chamber 55. The positive electrode 102 is provided at its upper portion with a hole 110 for feeding the seed gas 7 from the seed gas supply unit 58 into the chamber 50. The sheath Gas 60 is fed from the horizontal hole 60 into the insulating tube 22 via a helical spacer 60B. The inside diameter of the insulating tube 22 is set to, say, 100 mm or more. For the sheath gas 60 and the carrier gas 80, preferably the same gas as the seed gas 7 should be used.

In the present embodiment there are further provided an AC power source 14 and a coil 15 connected to the power source 14 and wound to surround the chamber 55. When the coil 15 is supplied with an AC power from the power source 14, a magnetic field is produced in the space 55. The AC power source 14 has an output capacity of, for example, 40 to 50 kW or greater. The coil 15 is formed to surround the insulating tube 22 and is immersed in cooling water 20 that flows between an insulating container 21 and the insulating tube 22. The insulating container 21 is interposed between the positive electrode 102 and a flange 42.

The operation of the present embodiment will be described below.

First, the seed gas 7 is fed from the supply unit 58 through the hole 110 into the chamber 50 within the positive electrode 102. The seed gas 7 then passes through the nozzle 108 into the chamber 55 within the insulating tube 22. When the switch 111 is turned oN in this state, a voltage is applied between the electrodes 101 and 102 by the high-voltage pulse power source 105. This high-voltage pulse application causes a discharge to occur between the tip of the negative electrode 101 and the portion of the positive electrode 102 which is in the vicinity of the nozzle 108, whereby the seed gas 7 suffers dielectric breakdown and is converted into plasma. If the spacing between the positive electrode 102 and the negative electrode 101 is set to, say, 1 mm, then the peak value of the high-voltage pulse applied between them is required to be at least 1,000 volts. At the plasma generation phase the pressure of the seed gas has been decreased to 100 to 200 Pa, at which a plasma is easily generated, even with a DC voltage applied. The paired electrodes 103 continue to be supplied with a voltage from the DC power source 104 even after the application of the high-voltage pulse, so that the plasma state of the seed gas is maintained. The applied DC voltage required to maintain the plasma state should preferably range from 30 to 5.0 volts. If, however, the electrode spacing is set to, say, 1 mm, that voltage may be a minimum of 20 volts. The seed gas 7 is fed continuously into the chamber 50 even after the generation of plasma; thus, the plasma jet 107 that is the seed gas in the plasma state will flow downwards from the nozzle 108 along the central axis of the insulating tube 22. At this point, the flow rate of the seed gas 7 from the supply unit 58 should preferably lie in the range of 10 to 30 l/min.

Figure 2:
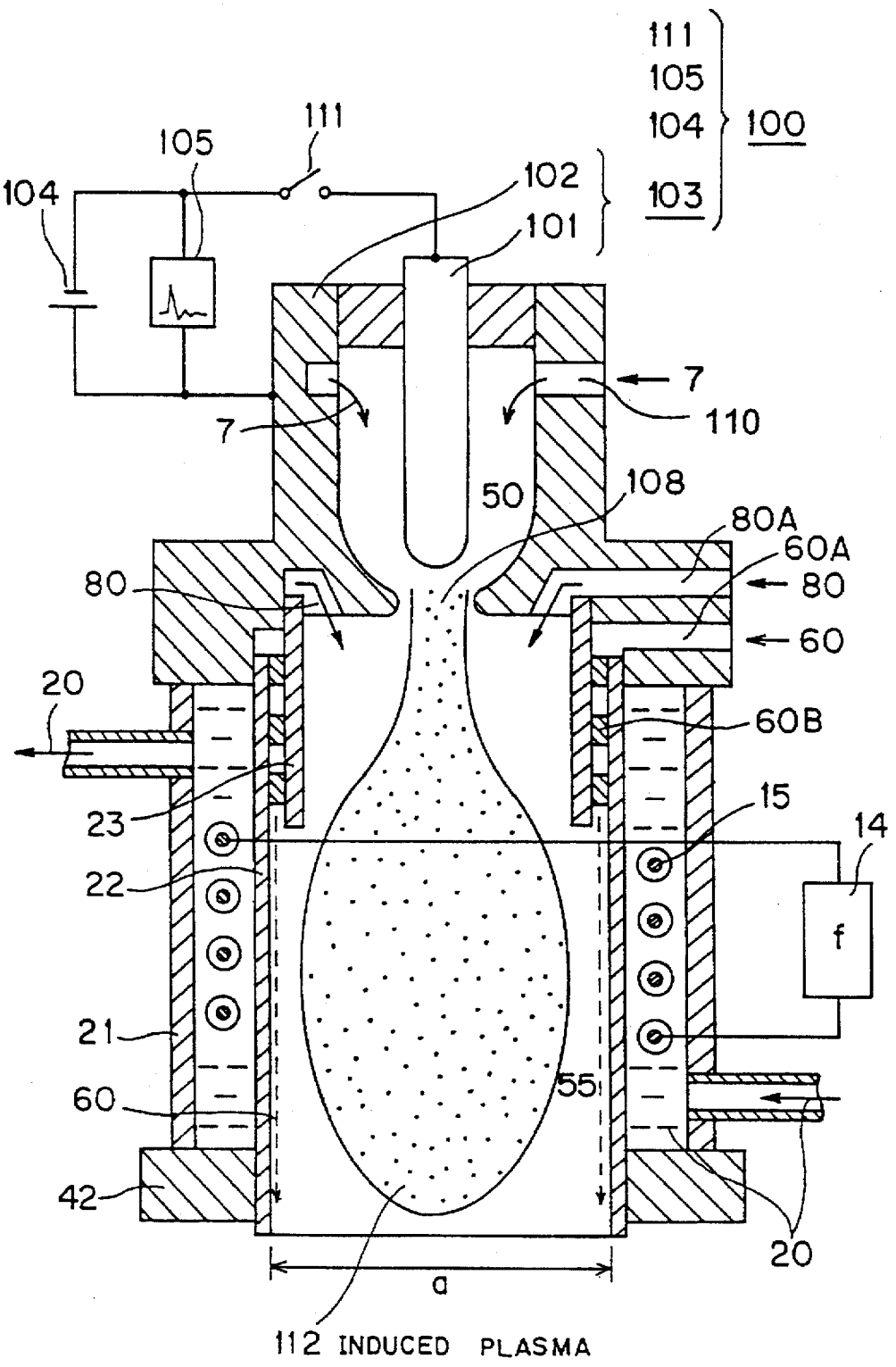
FIG. 2 shows a state where an induced plasma has been generated in the apparatus of FIG. 1.

FIG. 2 shows the state in which an induced plasma 112 has been formed by the plasma jet 107 serving as an initiating source in the apparatus of FIG. 1. This induced plasma 112 is formed in the manner described below.

The coil 15 disposed around the insulating tube 22 is supplied with an alternating current from the AC power source 14, so that a magnetic field is formed in the chamber 55 within the insulating tube 22. When the plasma jet 107 flows into the chamber 55, induced currents are produced inside the insulating tube 22, whereby the induced plasma 112 is generated. The insulating tube 22 is greater in inside diameter than the container of the positive electrode 102, so that the plasma jet 107 expands in the radial direction of the insulating tube 22 with the carrier gas and grows into the wider induced plasma 112.

According to an experiment carried out using the plasma generating apparatus of the present embodiment, an induced plasma having a diameter of 100 mm and a substantially uniform internal temperature could be generated. The experimental conditions were such that the inside diameter a of the insulating tube 22 was 100 mm, and the frequency f of a current supplied from the AC power source 14 to the coil 15 was 42 kHz. The radial temperature distribution of radius of the induced plasma 112 generated was substantially uniform, of the order 10,000K±500K. Thus, an induced plasma having a diameter that is much greater than a diameter of 50–60 mm, which is the limit in the prior art apparatus, can be generated by the use of a low-frequency power source of 500 KHz or below, as a power source for heating and maintaining plasma in place of a radio-frequency power source.

The plasma jet 107 shown in FIG. 1 serves as an initiating source for generating the induced plasma 112. The frequency of an AC current flowing through the coil 15 is within the non-radio frequency range of 500 KHz or below; thus, with this AC current only, the seed gas cannot be converted into plasma. However, with the present embodiment, the plasma torch 100, which is adapted to generate a plasma by the use of the DC power source 104, is provided; thus, no RF power source with a frequency in the megahertz range is required. In addition, since a high-voltage pulse used to change the seed gas to the plasma state is supplied from the high-voltage pulse source 105, it is not required for the DC power source 104 to output a high voltage. The DC power source 104 used in the present embodiment may be of a small output capacity of the order of 1 kW; i.e., it has only to be capable of outputting about 30 volts and 30 amperes. Moreover, after the induced plasma 112 has been initiated, even if the switch 111 is turned OFF, the plasma continues to exist. That is, it may be only when the plasma 112 is struck that the DC power source 104 and the pulse power source 105 are required. Accordingly, unlike the prior art apparatus, the plasma torch 100 does not require a coil, cooling water, and an AC power source, and an induced plasma generating apparatus that is inexpensive and simple in construction can be provided.

Furthermore, since, unlike the prior art apparatus, the present embodiment does not require application of a high voltage between both ends of an insulating tube opposed to each other in the direction of its axis, an induced plasma can be generated without the application of a high voltage by setting the electrode spacing to a small value. Thus, the pulse power source 105 has only to have the minimum ability necessary to initiate the plasma jet 107 independently of the size of the insulating tube 22. In order to readily generate the induced plasma 112, it is better for the plasma jet 107 fed into the insulating tube 22 to extend in the axial direction of that tube. In the present embodiment, the length of the plasma jet 107 can be adjusted easily by changing the seed gas feeding pressure in the seed gas supply unit 58. Note that, in the present embodiment, the high-voltage power source 105 is not necessarily required. Instead of using the power source 105, the DC power source 104 may be arranged such that its output voltage is temporarily raised to a magnitude sufficient to permit a discharge to take place between the paired electrodes 103, and is then reduced to a magnitude at which the plasma jet 107 is kept stable.

Embodiment 2

Figure 3:
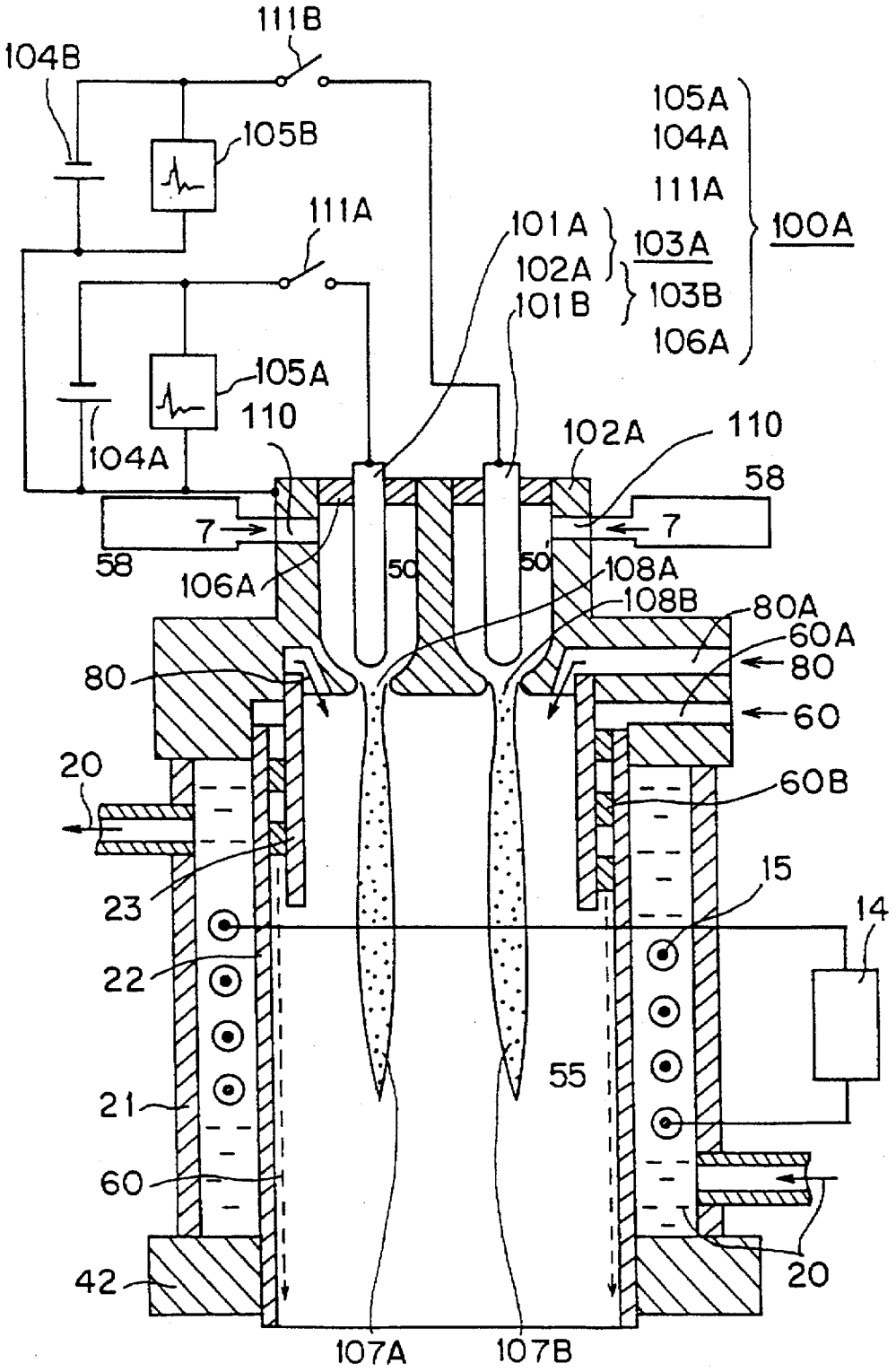
FIG. 3 is a sectional view of a plasma generating apparatus according to a second embodiment of the present invention.

Hereinafter, a second embodiment of the present invention will be described with reference to FIGS. 3 and 4.

An induced plasma generating apparatus of the second embodiment comprises a plasma torch 100A having chambers 50 and 50' for receiving seed gases from seed gas supply units 58. Each of the chambers 50 and 50' is covered with an insulator 106A. Negative electrodes 101A and 101B are disposed, supported by the insulator 106A, within the chambers 50 and 50', respectively. A positive electrode 102A forms a container that defines the chambers 50 and 50'. The positive electrode 102A is opposed to the negative electrode 101A to form a pair of electrodes 103A in the chamber 50 and to the negative electrode 101B to form a pair of electrodes 103B in the chamber 50'. The pair of electrodes 103A is connected in parallel with a DC power source 104A and a high-voltage pulse power source 105A through a switch 111A, while the pair of electrodes 103B is connected in parallel with a DC power source 104B and a high-voltage pulse power source 105B through a switch 111B. The paired electrodes 103A and 103B function identically to the paired electrodes 103 in the first embodiment. A nozzle 108A is formed in that portion of the positive electrode 102A which faces the lower end of the negative electrode 101A, while a nozzle 108B is formed in that portion of the positive electrode 102A which faces the lower end of the negative electrode 101B. A plasma produced in the chamber 50 is ejected, as a plasma jet 107A, into space in the insulating tube 22 via the nozzle 108A, while a plasma produced in the chamber 50' is ejected, as a plasma jet 107B, into space in the insulating tube 22 via the nozzle 108B. The ejection of the plasma jets 107A and 107B into the chamber 55 is due to the pressure of seed gases fed from the supply units 58 into the chambers 50 and 50'. With respect to other arrangements the second embodiment is the same as the first embodiment. The positive electrode 102A can be electrically divided into two or more parts for respective negative electrode and each of the parts can be connected to a DC power source and a high-voltage pulse power sourse.

Figure 4:
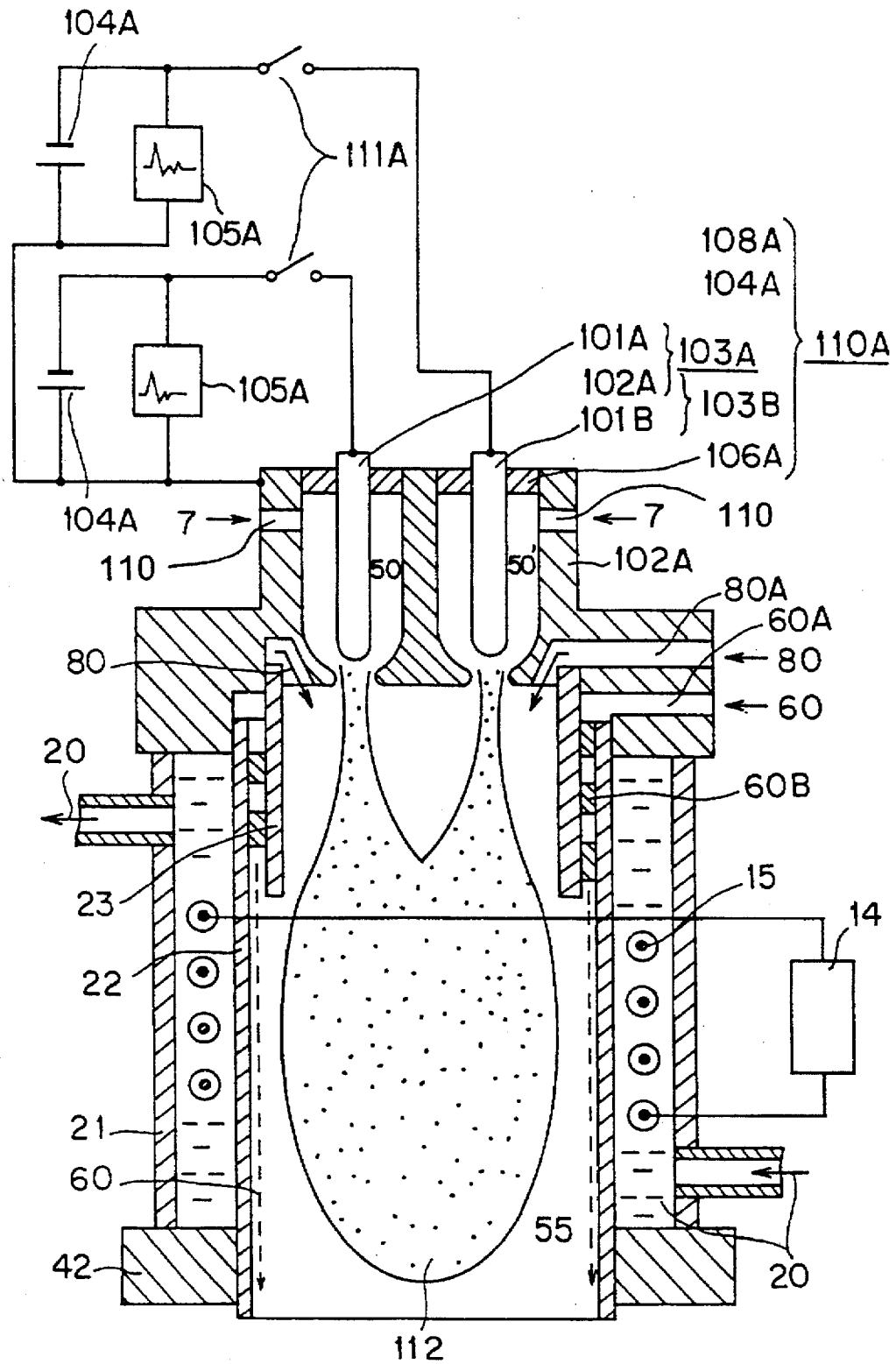
FIG. 4 shows a state where an induced plasma has been generated in the apparatus of FIG. 3.
Figure 5:
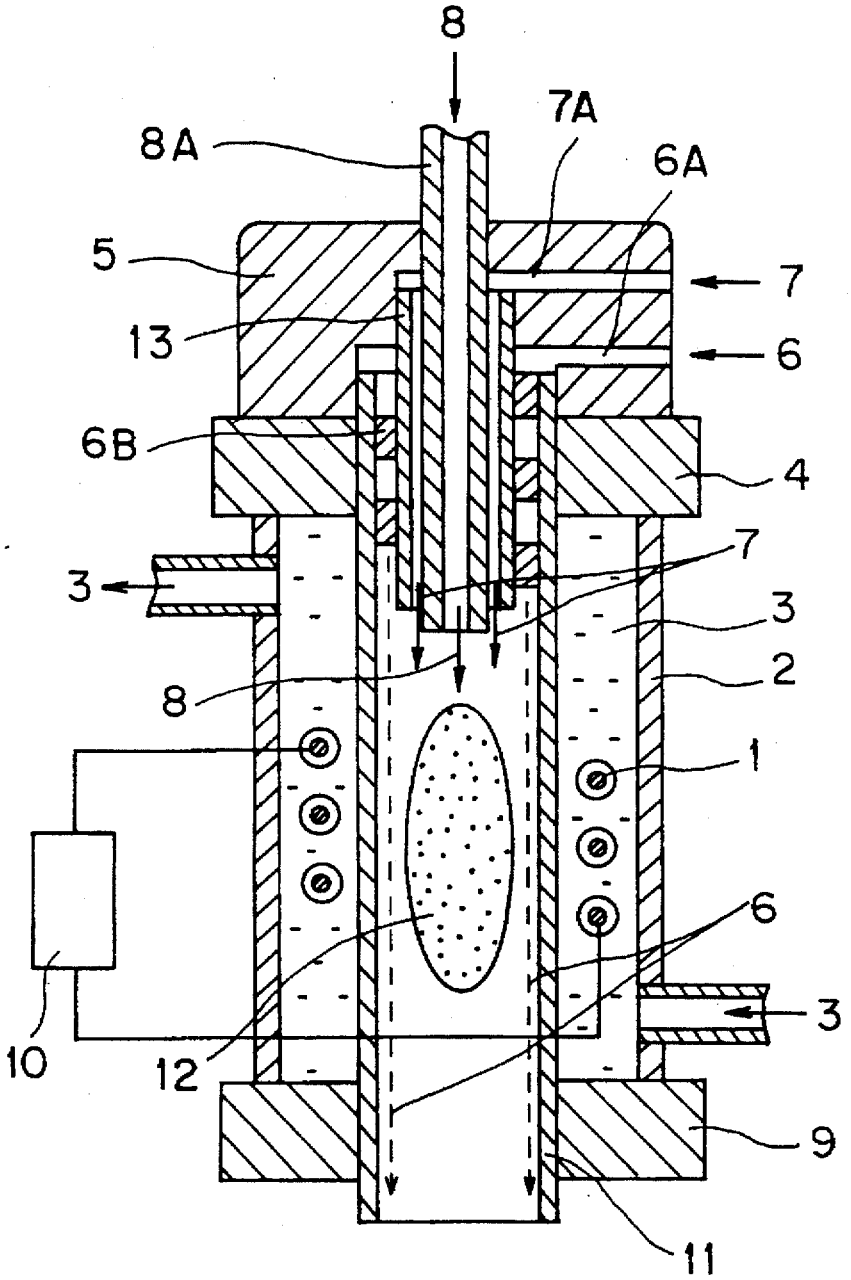
PRIOR ART Fig. 5
FIGS. 5 and 6 are sectional views of conventional induced plasma generating apparatuses.
Figure 6:
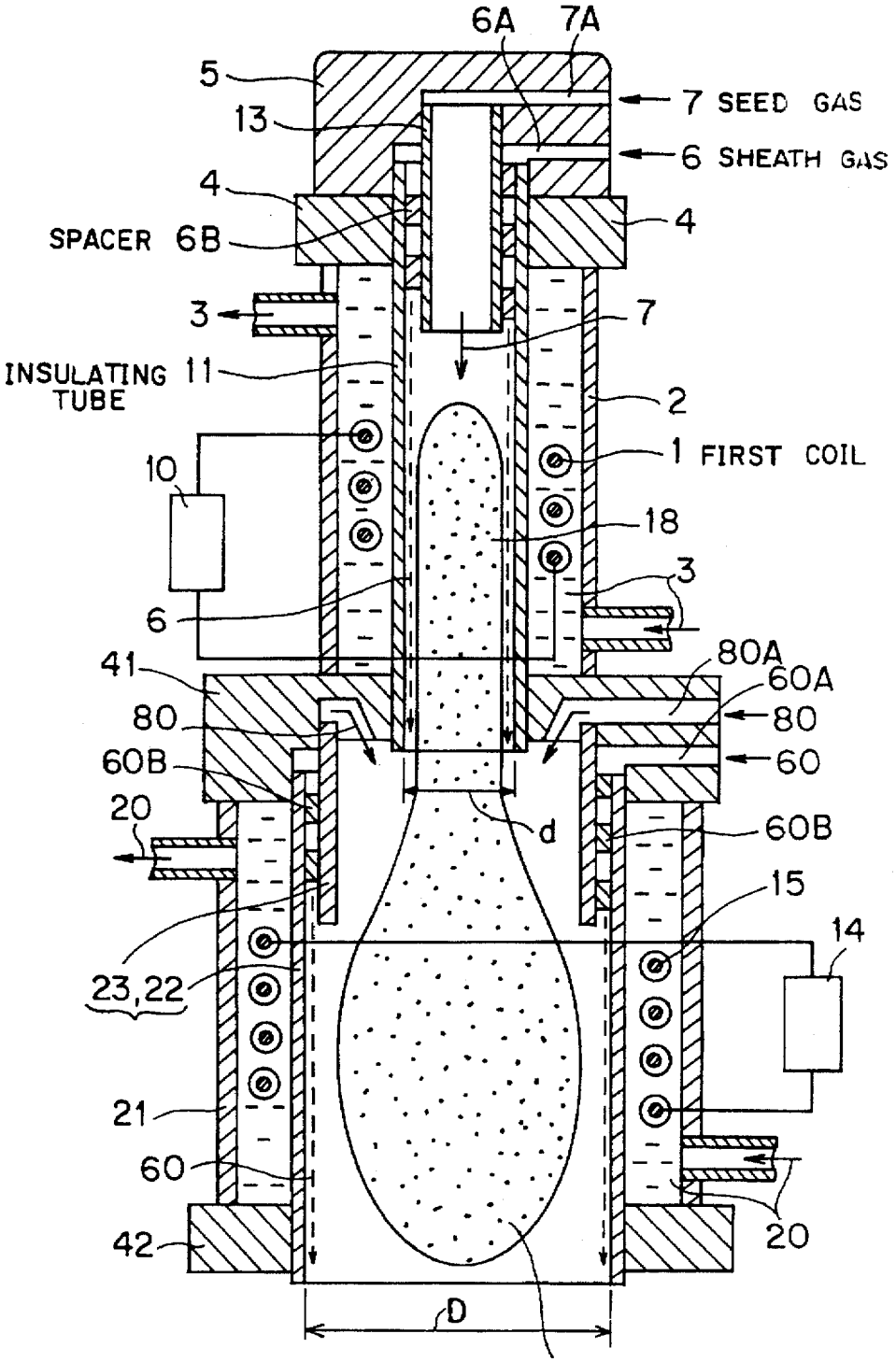
PRIOR ART Fig. 6

As shown in FIG. 4, an induced plasma 112A is generated by subjecting the plasma jets 107A and 107B to a magnetic field produced by the coil 15. The mechanism by which the plasma jets 107A and 107B grow into the induced plasma is the same as that described in connection with the first embodiment.

With the second embodiment, since multiple plasma jets can be used to generate an induced plasma, it becomes possible to generate an induced plasma 112A of a much greater diameter by making the inside diameter of the insulating tube 22 much greater. When the inside diameter of the insulating tube 22 is great, the use of multiple plasma jets that are distributed uniformly in the insulating tube is preferable to the use of a single plasma jet for easier plasma jet initiation. According to the present embodiment, an induced plasma of a greater diameter can be generated readily. In addition, the use of more than one plasma jet also reduces the time that elapses from the plasma jet ejection to the time when an induced plasma is formed. The present inventor has confirmed by experiment that, when two plasma jets are used, the elapsed time is reduced to half of the time when a single plasma jet is used. The present embodiment can therefore reduce the amounts of the seed gas 7, the sheath gas 60 and the carrier gas 80 which are supplied during the time that elapses from the ejection of plasma jets to the time when an induced plasma is formed.

Although the second embodiment has been described as being provided with the two chambers 50 and 50', the number of chambers may be further increased, depending on the inside diameter of the insulating tube. The greater the number of the chambers, the greater diameter the induced plasma will have. The use of an induced plasma having a greater diameter permits film formation or etching processing to be performed on a large area of the surface of a material at a time. The DC power source, the high-voltage pulse source, and the switch, may be used in common to a plurality of pairs of electrodes.

In the induced plasma generating apparatus of the present invention, since low voltage and low current are used to generate a plasma, the amount of impurities generated from the paired electrodes can be decreased. In addition, since the generation of plasma jets can be suspended while material is being processed after the Generation of an induced plasma, impurities are prevented from contaminating the induced plasma. Thus, the effect of impurities can virtually be disregarded.

In the induced plasma Generating apparatus of the present invention, the plasma torch which ejects a plasma jet serving as an induced plasma initiating source is placed at one end of the insulating tube; thus, no RF power source is required and the support facilities can be made small and inexpensive. In addition, in place of an RF power source, a power source of a low frequency of 500 KHz or below can be used as an induction current source for heating and maintaining a plasma. If an RF power source is used, then surrounding metals will be subjected to induction heating and the operation of peripheral equipment for power control, voltage and current measurement, plasma temperature measurement and the like will be disturbed by electrical noise. Such problems are decreased in the present invention where a low-frequency power source is used. Moreover, the provision of multiple plasma generation chambers allows an induced plasma to be struck readily and any size of plasma to be generated. Thereby, a large area of the surface of a material can be subjected to surface processing at a time and therefore the processing efficiency can also be increased. Furthermore, since the time taken to strike an induced plasma is short, the seed gas, sheath gas and carrier gas can be used economically.

What is claimed is:

1. A method of generating an induced plasma comprising:

a first step of generating a plasma by causing a discharge between paired electrodes with a DC power source in a first chamber containing a seed gas;

a second step of feeding said plasma into a second chamber containing a sheath gas; and a third step of generating an induced plasma by supplying an AC current to a coil surrounding said second chamber for causing a magnetic field generated by said AC current to act on said plasma in said second chamber, wherein the frequency of said AC current is not higher than 500 KHZ.

2. The method according to claim 1, further comprising a fourth step of producing a high-voltage pulse using said DC power source, wherein said plasma is generated by applying said high-voltage pulse between said paired electrodes and causing a discharge in said seed gas.

3. The method according to claim 2, further comprising a fifth step of applying a voltage between said paired electrodes after the first step.

4. The method according to claim 3, wherein said voltage applied between said paired electrodes in said fifth step ranges from 30 to 50 volts.

5. The method according to claim 1, wherein said plasma is fed into said second chamber by said seed gas which is supplied to said first chamber in said second step.

6. The method according to claim 5, wherein the flow rate of said seed gas supplied to said first chamber ranges from 10 to 30 l/min.

7. The method according to claim 3, further comprising a sixth step of generating a second plasma in a third chamber using a DC power source, wherein said magnetic field acts on said plasma and said second plasma to generate said induced plasma.

8. An induced plasma generating apparatus comprising:

seed gas supply means for supplying a seed gas;

a first chamber for receiving said seed gas;

a DC power source for generating a DC voltage;

a pair of electrodes connected to said DC power source for causing a discharge in said first chamber in order to generate a plasma from said seed gas;

a nozzle for ejecting said plasma from said first chamber;

a second chamber for receiving said plasma ejected from said first chamber through said nozzle;

sheath gas supply means for supplying a sheath gas to said second chamber;

an AC power source for generating an AC current wherein the frequency of said AC current is not higher than 500 KHZ; and a coil connected to said AC power source and disposed to surround said second chamber for producing a magnetic field in said second chamber to generate an induced plasma from said plasma.

9. The apparatus according to claim 8, further comprising high-voltage pulse generating means connected to said DC power source and said pair of electrodes for generating a high-voltage pulse used to generate said plasma in said first chamber.

10. The apparatus according to claim 8, wherein one of said pair of electrodes forms a container that defines said first chamber.

11. The apparatus according to claim 8, further comprising an insulating tube for defining said second chamber.

12. The apparatus according to claim 8, wherein said plasma is fed from said first chamber into said second chamber by said seed gas supplied by said seed gas supply means into said first chamber.

13. The apparatus according to claim 8, wherein the flow rate of said seed gas supplied from said seed gas supply means to said first chamber ranges from 10 to 30 l/min.

14. The apparatus according to claim 8, further comprising a third chamber for receiving a seed gas; and a second pair of electrodes connected to a DC power source for causing a discharge in said third chamber to generate a second plasma in said third chamber, wherein said induced plasma is generated by subjecting said plasma and said second plasma to said magnetic field produced by said coil connected to said AC power source.

* * * * *

UNITED STATES PATENT AND TRADEMARK OFFICE

CERTIFICATE OF CORRECTION

PATENT NO. : 5,680,014
DATED : October 21, 1997
INVENTOR(S) : Miyamoto et al.

It is certified that error appears in the above-identified patent and that said Letters Patent is hereby corrected as shown below:

Column 6, line 50, delete "60" and insert --

60A-- therefor. (second occurrence)

Column 7, line 22, delete "5.0" and insert --

50-- therefor.

Signed and Sealed this

Eighteenth Day of August, 1998

Bruce Lehman

*Attest:*

BRUCE LEHMAN

*Attesting Officer*

*Commissioner of Patents and Trademarks*